US006837733B2

(12) United States Patent
Katsuma

(10) Patent No.: US 6,837,733 B2
(45) Date of Patent: Jan. 4, 2005

(54) CONNECTOR WITH COVER RETAINED AT PARTLY ASSEMBLED POSITION AND MOVABLE TO PROPERLY ASSEMBLED POSITION

(75) Inventor: Takatoshi Katsuma, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/284,549

(22) Filed: Oct. 30, 2002

(65) Prior Publication Data

US 2003/0087548 A1 May 8, 2003

(30) Foreign Application Priority Data

Nov. 7, 2001 (JP) ..... 2001-342159

(51) Int. Cl.[7] ..... H01R 29/00
(52) U.S. Cl. ..... 439/352; 439/489
(58) Field of Search ..... 439/188, 350, 439/352, 488, 489, 694, 902, 466, 468, 881

(56) References Cited

U.S. PATENT DOCUMENTS

| | | | | |
|---|---|---|---|---|
| 5,647,757 A | * | 7/1997 | Chrysostomou | 439/352 |
| 6,102,732 A | | 8/2000 | Seko et al. | 439/489 |
| 6,276,953 B1 | * | 8/2001 | Gauker et al. | 439/352 |
| 6,364,683 B1 | * | 4/2002 | Kohno | 439/352 |

* cited by examiner

*Primary Examiner*—Tho D. Ta
*Assistant Examiner*—Felix O. Figueroa
(74) *Attorney, Agent, or Firm*—Gerald E. Hespos; Anthony J. Casella

(57) ABSTRACT

A connector (Fa) has a housing (10) in which terminal fittings (14) are accommodated. A cover (30) can be assembled with the housing 10 to cover the terminal fittings (14). The connector (Fa) also has a detector (35) for detecting whether the housing (10) is connected properly with a mating connector (M) based on whether the detector (35) can be assembled with the housing (10) at a properly assembled position. The housing (10), the cover (30) and the detector (35) are prepared as two units. Thus, assembling operability is better as compared to a case where these three are prepared separate.

6 Claims, 22 Drawing Sheets

CONNECTOR WITH COVER RETAINED AT PARTLY ASSEMBLED POSITION AND MOVABLE TO PROPERLY ASSEMBLED POSITION

BACKGROUND OF THE INVENTION

1. Field of the Invention

The present invention relates to a connector with a connection detecting function and to a method for assembling such connector.

2. Description of the Related Art

A known connector with a connection detecting function is disclosed in U.S. Pat. No. 6,102,732. This connector has: a housing that accommodates terminal fittings, a cover assembled with the housing to cover the terminal fittings, and a detector to detect a connected state with a mating connector. The connector is assembled by first mounting the cover on the housing to cover the terminal fittings. The housing then is connected with the mating connector, and the detector is assembled with the housing to detect the connected state with the mating connector.

The housing, the cover and the detector of the prior art connector are separate parts. Thus, an operator has to pull the three parts toward him one by one to assemble the connector. Accordingly, there has been a demand for a connector that can be assembled more efficiently.

The present invention was developed in view of the above problem and an object thereof is to improve assembling operability.

SUMMARY OF THE INVENTION

The invention is directed to a connector that has a housing and at least one terminal fitting in the housing. A cover is assembled with the housing to substantially cover the terminal fitting. The connector also has detecting means for detecting whether the housing is connected properly with a mating connector based on whether the detecting means can be assembled with the housing at a properly assembled position. The connector further includes unifying means for partly assembling at least two of the housing, the cover and the detecting means for transfer to a proper assembly site and/or for unifying at least two of them into a single part. Thus, assembling efficiency is better than a case where these three are prepared and moved as separate parts.

The unifying means may comprise engageable guides on the housing and the cover. The cover preferably is slidable between a partly assembled position and a properly assembled position by the engagement of the guides. The guided movement of the cover ensures that the cover can be assembled with the housing easily and properly.

The detecting means may be assembled partly with the housing or the cover before the housing and cover are connected with the mating connector. The detecting means then may be moved to the properly connected position to detect whether the housing is connected properly with the mating connector. Thus, a detecting operation by the detecting means is performed quickly after a connecting operation, and operational efficiency is good.

The unifying means may include at least one hinge for unifying at least two of the housing, the cover and the detecting means into a single part. Thus, the number of parts can be reduced. For example, the detecting means may be coupled to the housing by at least one hinge before assembling the connector and may be located at a non-assembled position. The detecting means then can be rotated about the hinge from the non-assembled position and may be assembled properly with the housing.

The detecting means ay have at least one planar rib, and the housing and the cover may have at least one slit. A plate surface of the rib preferably extends substantially parallel with the longitudinal direction of the slit. Thus, the rib of the detecting member can be inserted into the slit of the cover and the housing. This insertion occurs as the detecting means is assembled with the housing at the properly assembled position. A moving direction of the detecting means is parallel with the longitudinal directions of the slit as the detecting means is turned. Thus, the plate surface of the rib is parallel with the longitudinal direction of the slit, and the slit merely needs an opening width equal to the thickness of the rib.

The cover or the detecting means may be coupled to the rear end of the housing by at least one hinge. Additionally, the terminal fitting may be connected with a wire at its rear end, and the housing may include a draw-out portion for drawing the wire out laterally. Accordingly, the wire does not interfere with the hinge, the cover or the detecting means.

The cover preferably is assembled with the housing for movement between a partly assembled position and a properly assembled position. Additionally, the detecting means preferably is formed integrally or unitarily with the cover. The cover may be moved from a partly assembled position to a properly assembled position when the housing is connected properly with the mating connector. However, movement of the cover from the partly assembled position to the properly assembled position is hindered when the housing is connected only partly with the mating connector.

The detecting means may be formed integrally with the cover to reduce the number of parts.

The connected state with the mating connector can be detected based on whether the cover can be moved from the partly assembled position to the properly assembled position. Accordingly, assembly of the cover and the connection detection by the detecting means can be performed by one action.

The detecting means preferably interferes with at least one locking means when the housing is assembled properly with the mating connector.

At least two terminal fittings preferably are accommodated in the housing and are shorted by short-circuiting means. The shorted state is interrupted by shorted-state interrupting means when the connector is mated properly with the mating connector.

The invention also is directed to a method for assembling a connector. The method comprises providing a housing that accommodates at least one terminal fitting. The method then comprises assembling a cover with the housing to substantially cover the terminal fitting, and detecting whether the housing is connected properly with a mating connector. The detecting step may be carried out with a detector based on whether the detector can be assembled with the housing at a properly assembled-position. The method further comprises partly assembling at least two of the housing, the cover and the detecting means with a unifying means so as to be transferable to a properly assembled state and/or unifying at least two of them into a single part.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
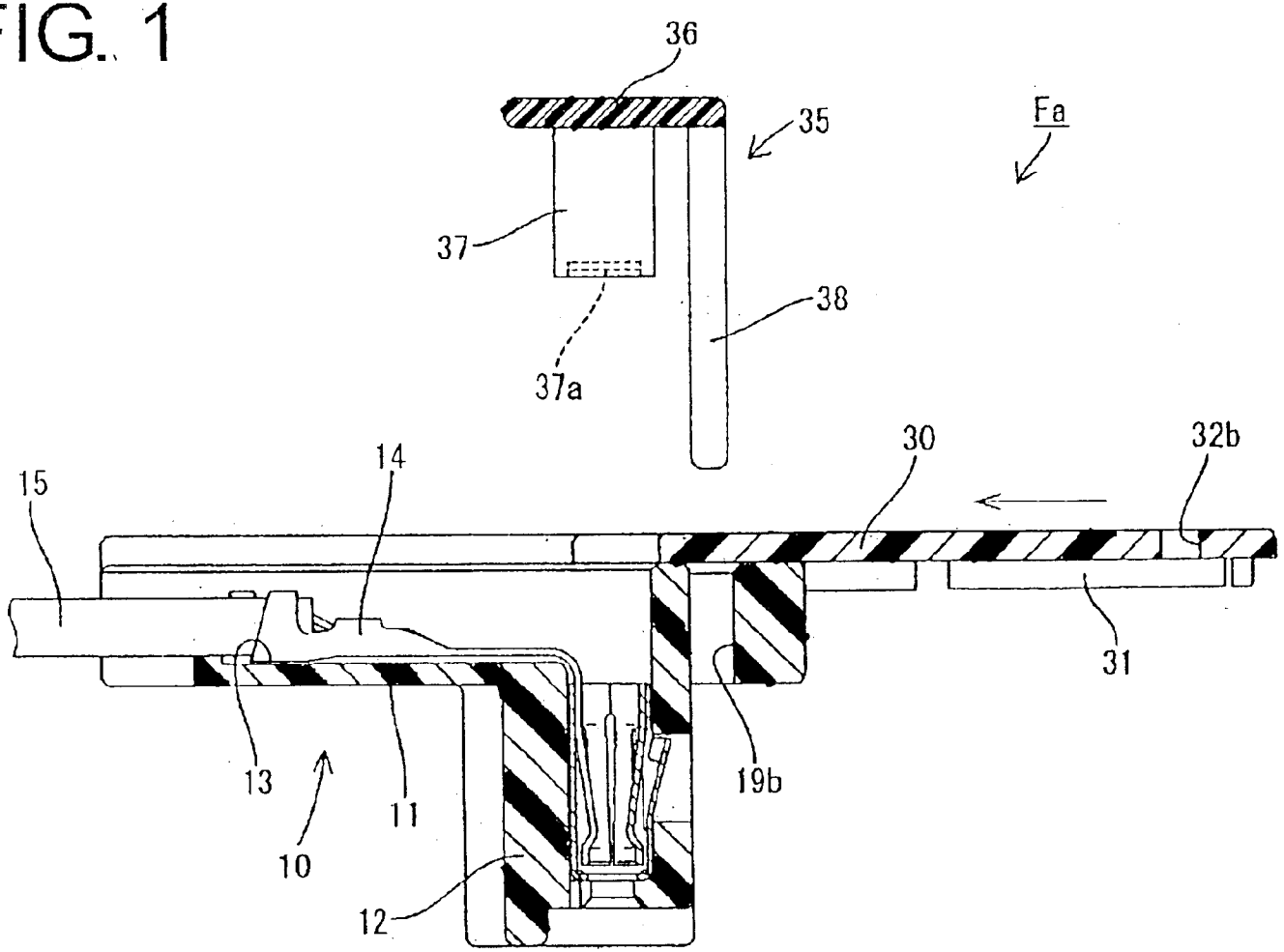
FIG. 1 is a longitudinal section of a first embodiment showing a cover partly assembled with a housing.
Figure 2:
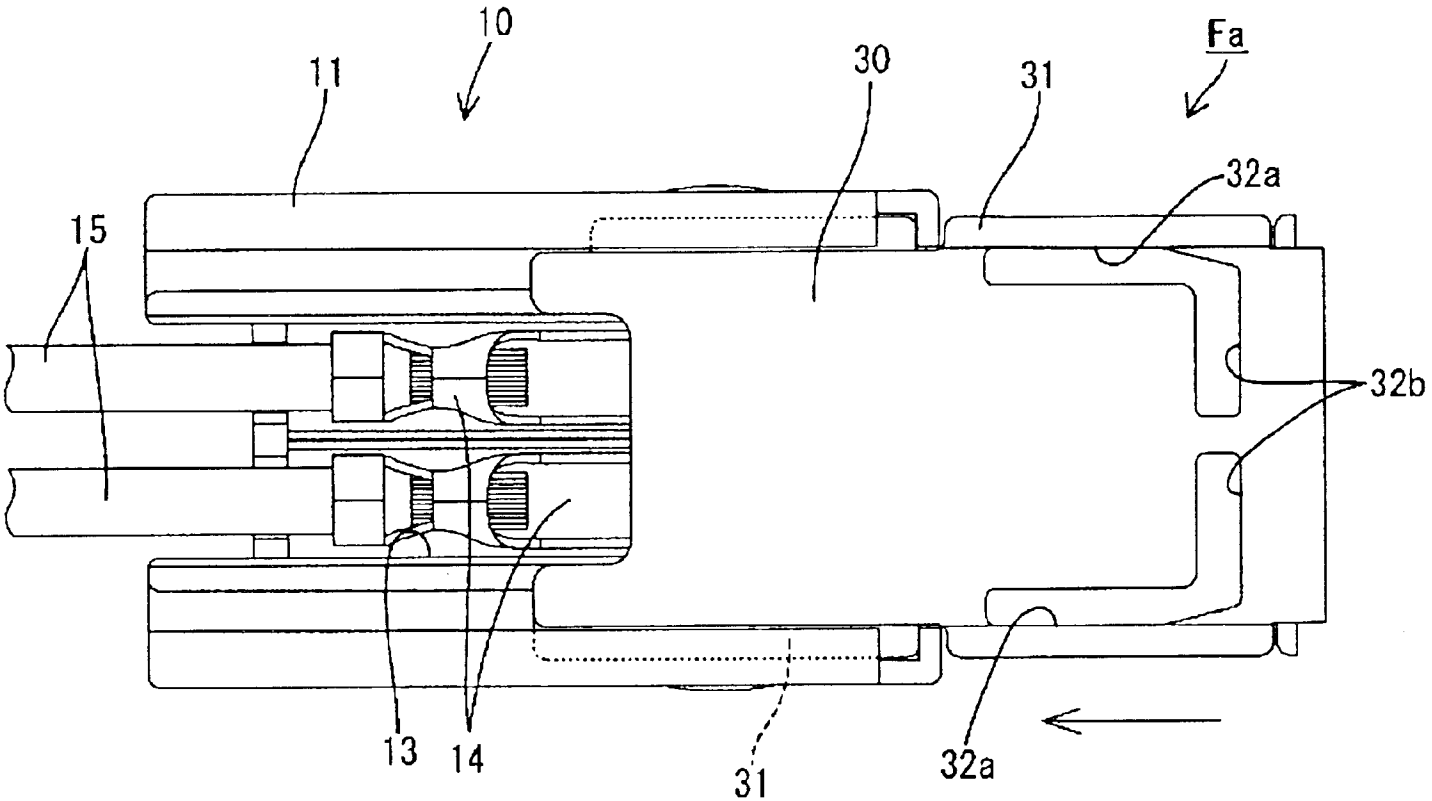
FIG. 2 is a plan view showing the cover partly assembled with the housing.
Figure 3:
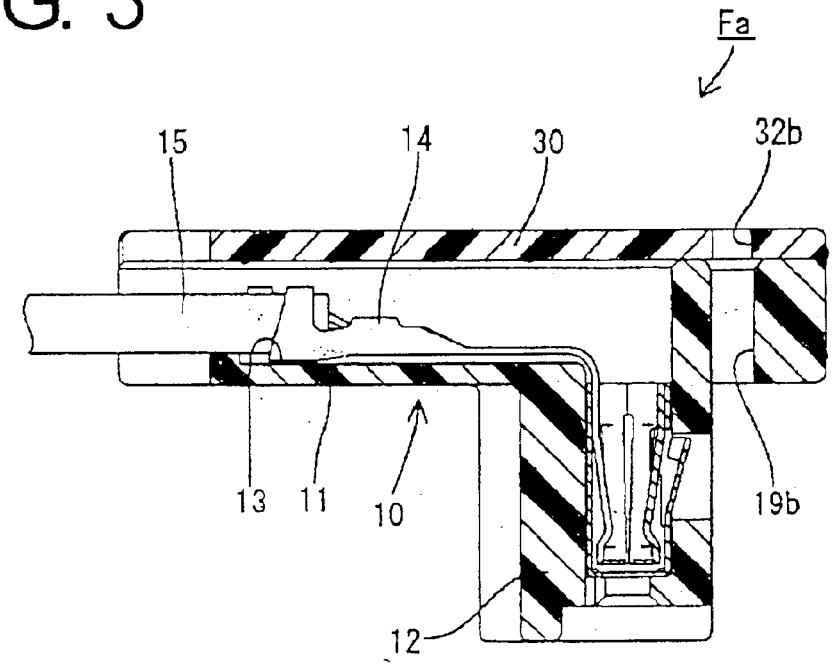
FIG. 3 is a longitudinal section showing the cover assembled with the housing.
Figure 4:
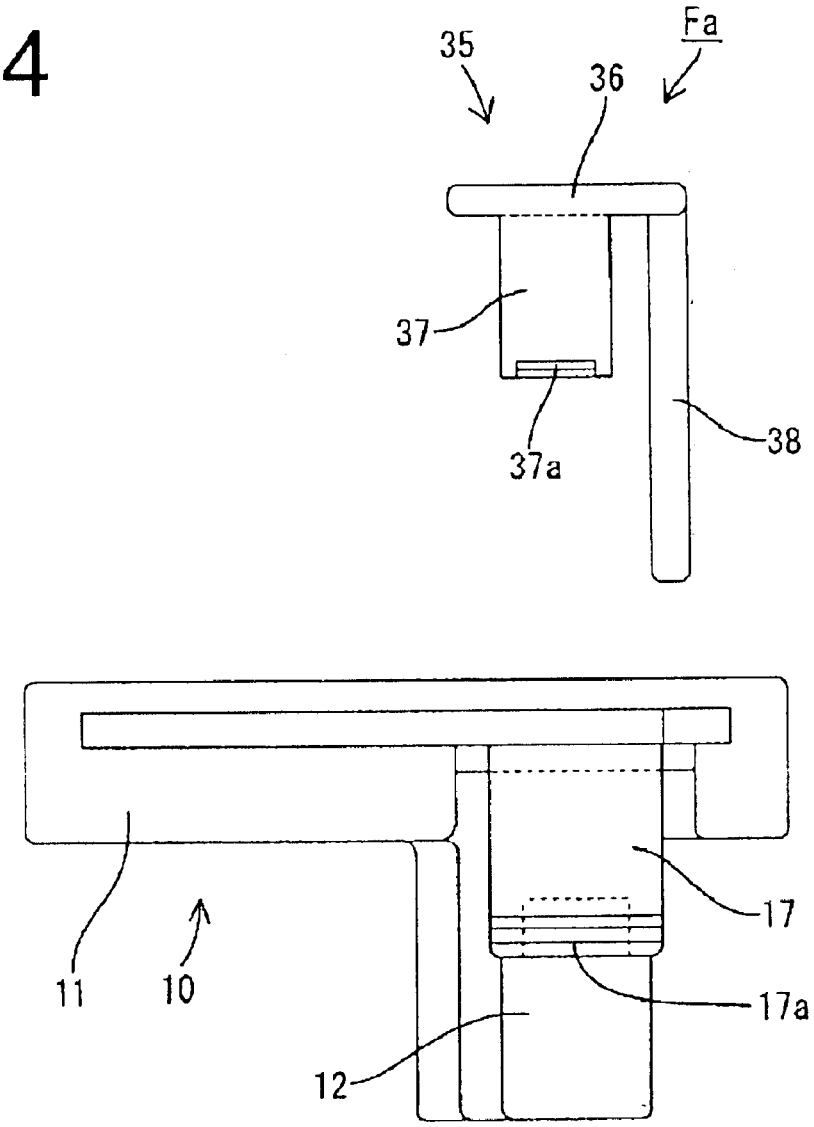
FIG. 4 is a side view showing the cover assembled with the housing.
Figure 5:
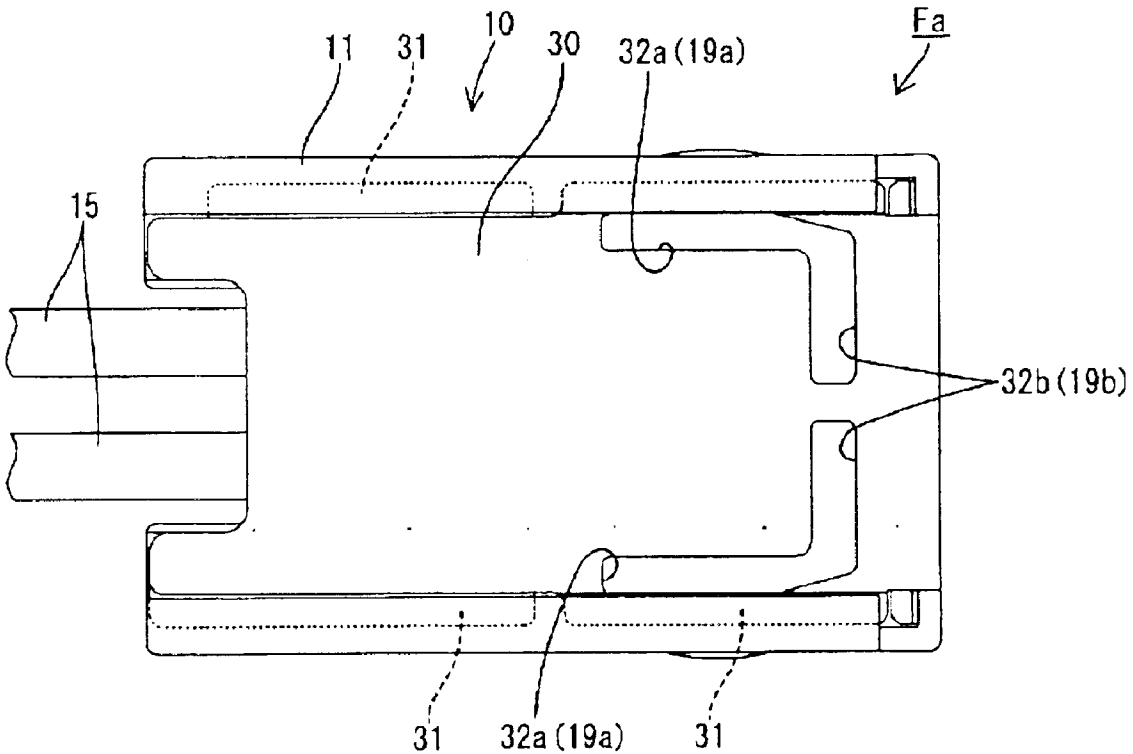
FIG. 5 is a plan view showing the cover assembled with the housing.
Figure 6:
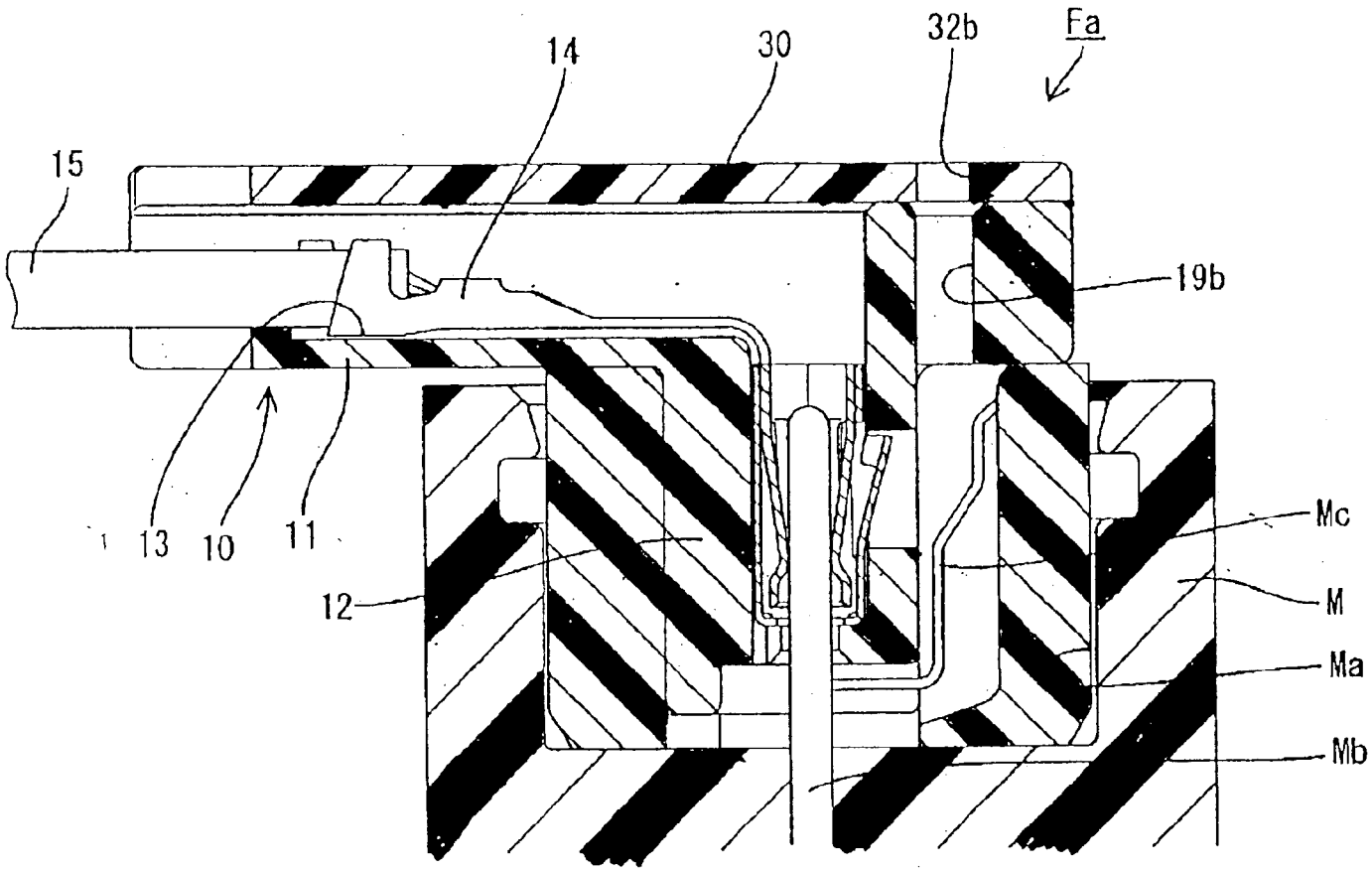
FIG. 6 is a longitudinal section showing a connector connected with a mating connector.
Figure 7:
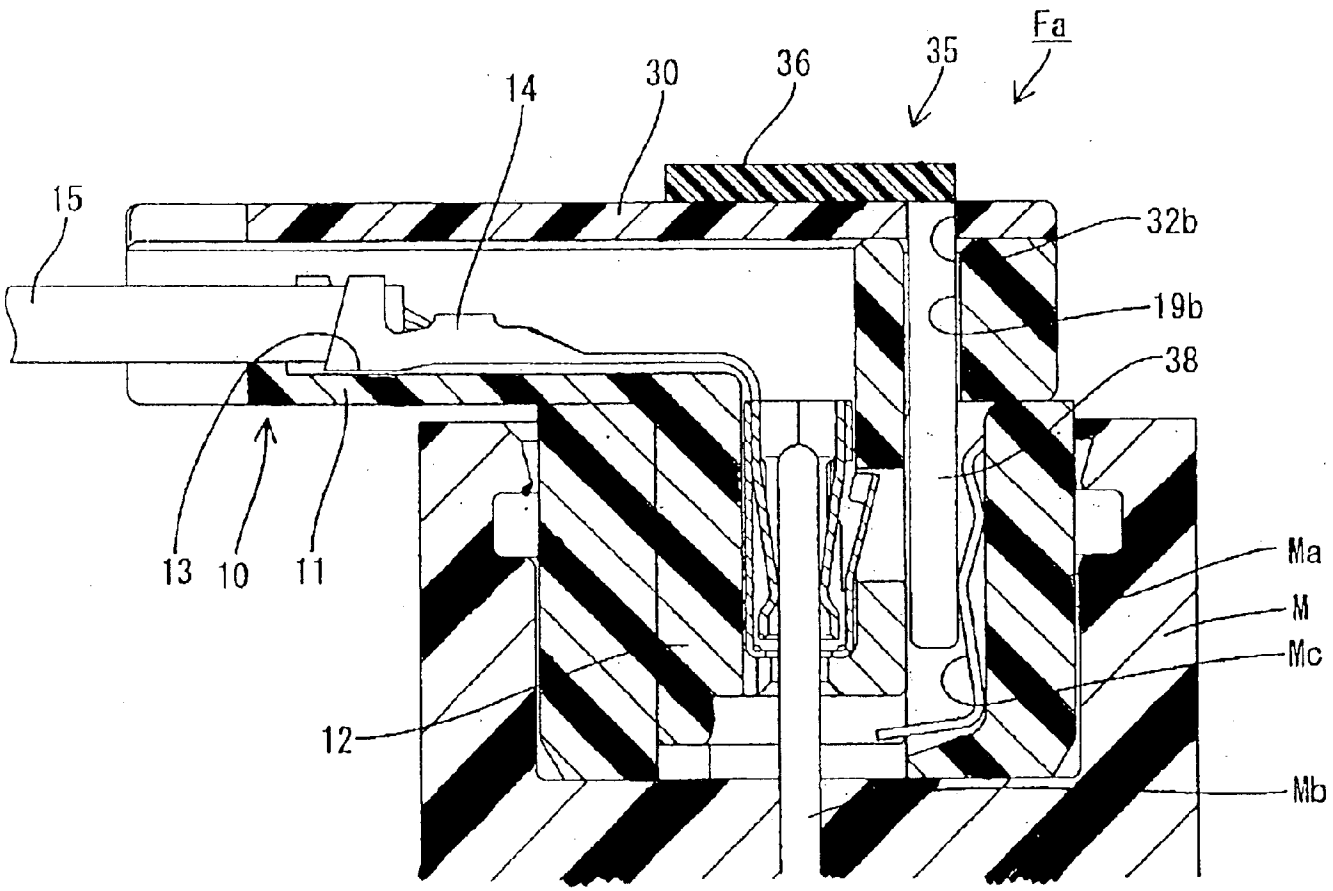
FIG. 7 is a longitudinal section showing a detector assembled.

A connector Fa according to a first embodiment of the invention is described with reference to FIGS. 1 to 14. The connector Fa has a housing 10, a cover 30 and a detector 35. The housing 10 has a substantially rectangular box-shaped main portion 11 with a front end to the right in FIG. 1 and a rear end to the left. A substantially rectangular fitting 12 projects down substantially normally from the bottom surface at the front end of the main portion 11. An upwardly open cavity 13 is formed in the main portion 11 and the fitting portion 12. Left and right female terminal fittings 14 are accommodated in the cavity 13, and wires 15 connected with the rear ends of the female terminal fittings 14 are drawn out from the rear end surface of the main portion 11.

Figure 8:
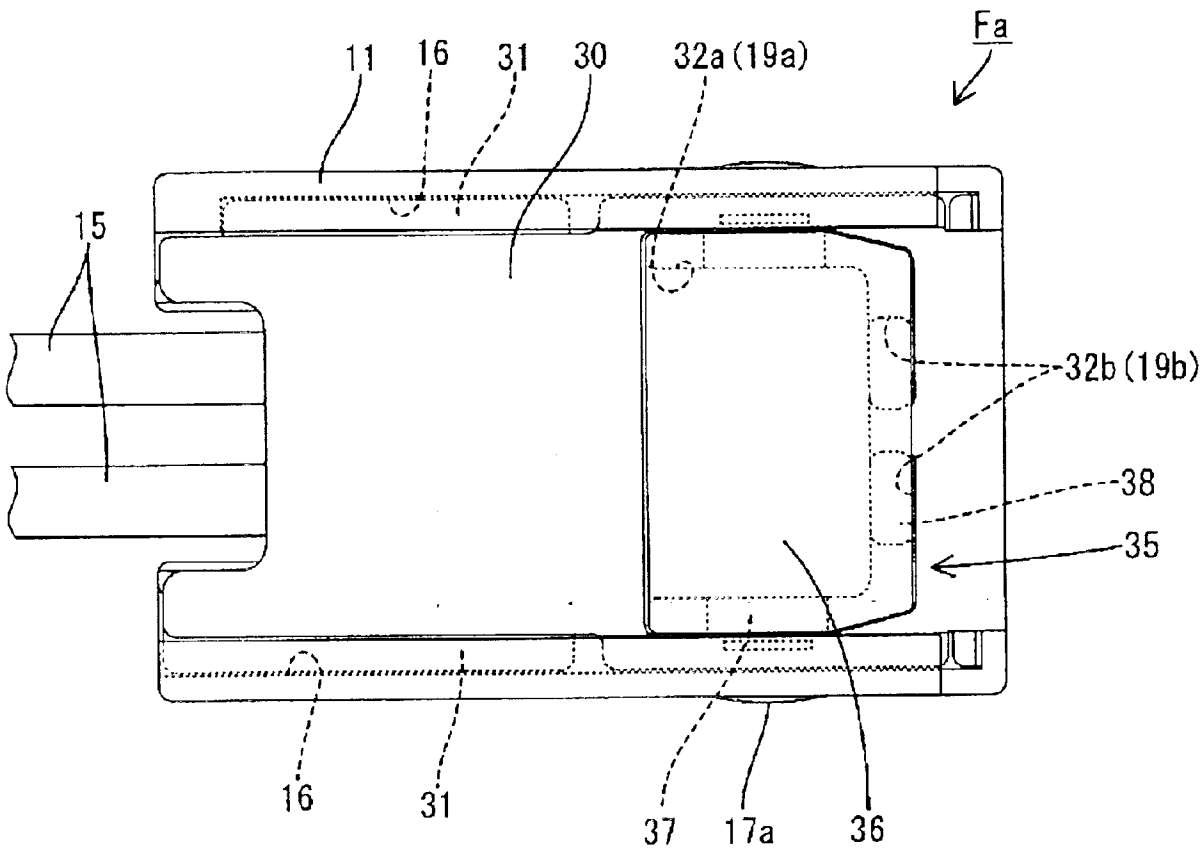
FIG. 8 is a plan view showing the detector is assembled.
Figure 9:
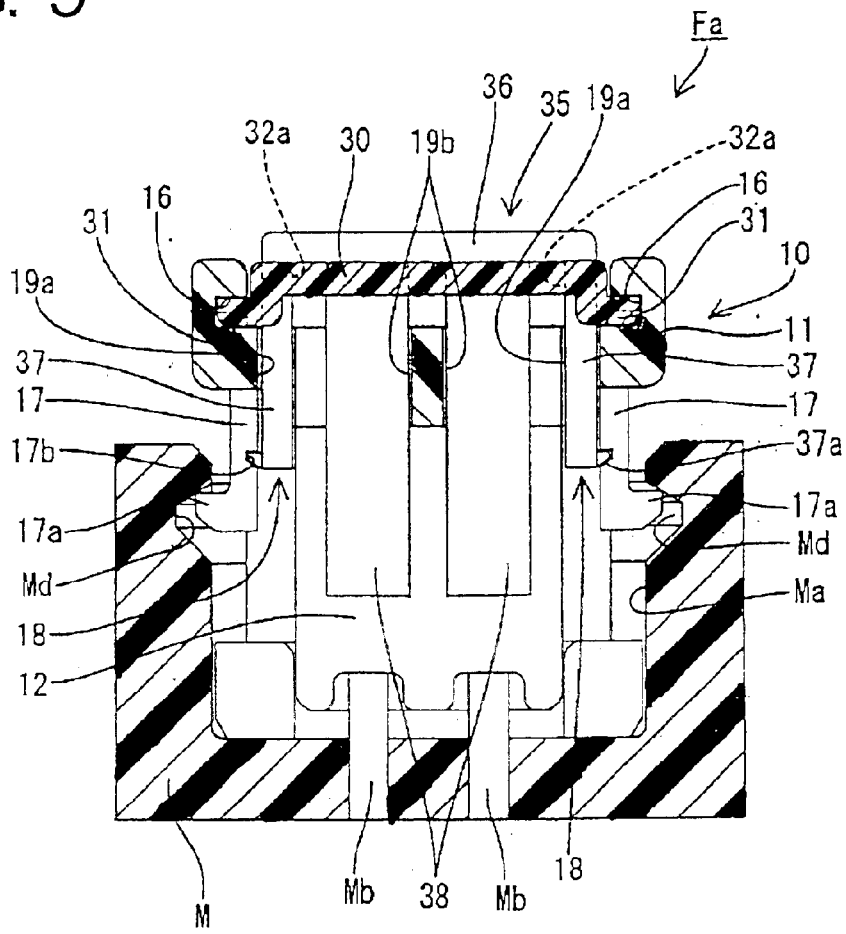
FIG. 9 is a lateral section showing the detector assembled.

Left and right guide grooves 16 extend forward and backward at the opening edges of the cavity 13 in the upper surface of the main portion 11 and open transversely inwardly (FIG. 8). More particularly, the side grooves 16 are formed at edges of the main portion 11 near the opening side of the cavity 13 and define recesses that face inwardly toward the cavity 13. Left and right lock arms 17 are formed at the front end of the housing 10 and project down along the left and right side surfaces of the fitting 12. Deformation permitting spaces 18 are defined between the inner surfaces of the lock arms 17 and the outer surfaces of the fitting 12 for enabling the lock arms 17 to be deformed in the process of connecting the connector Fa with a mating connector M. Locking grooves are formed in the inner surfaces of the lock arms 17.

Figure 10:
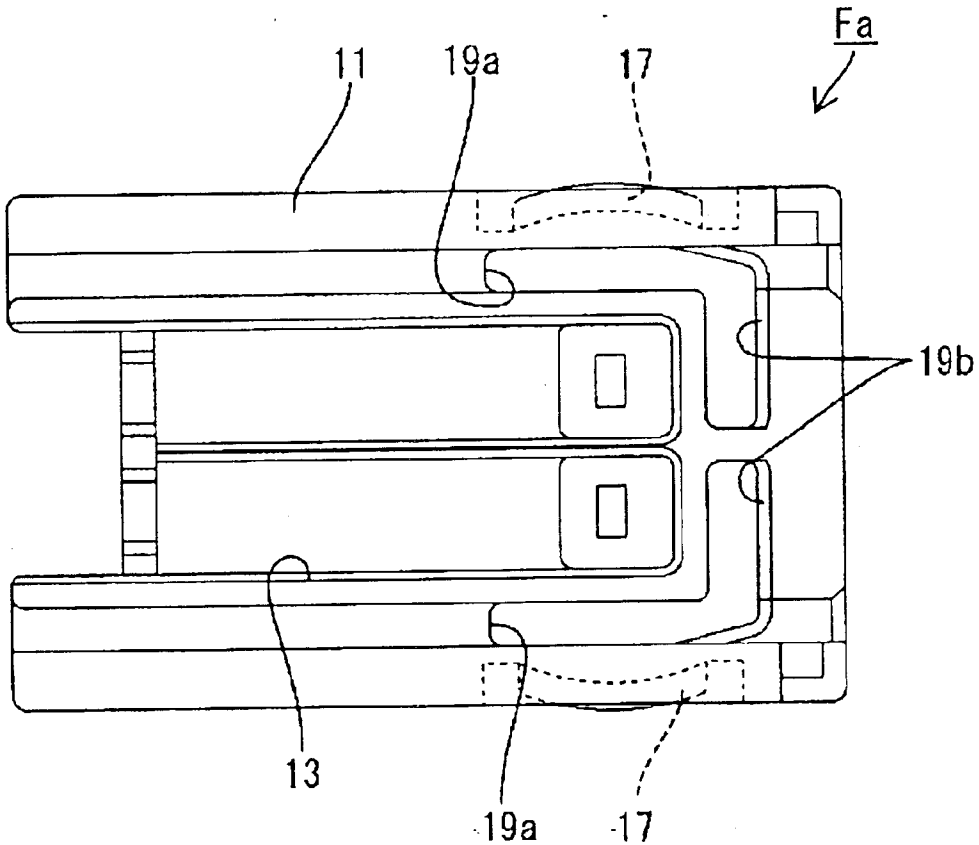
FIG. 10 is a plan view of the housing.
Figure 11:
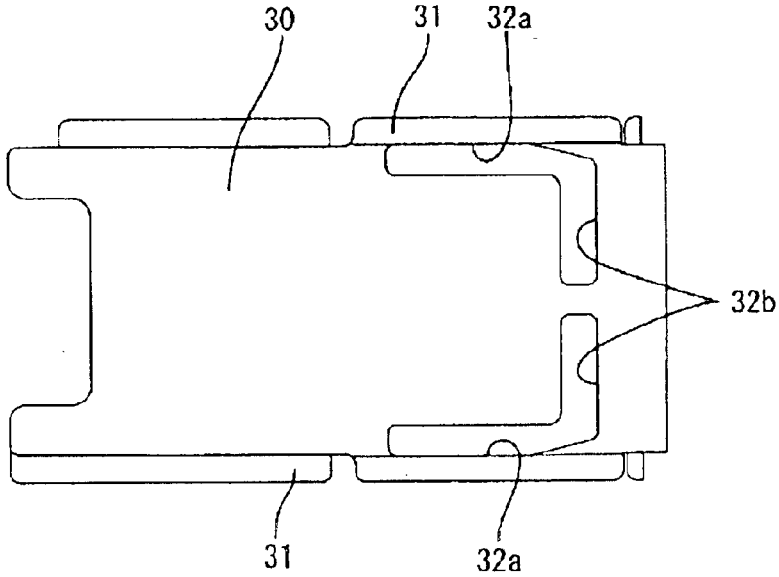
FIG. 11 is a plan view of the cover.
Figure 12:
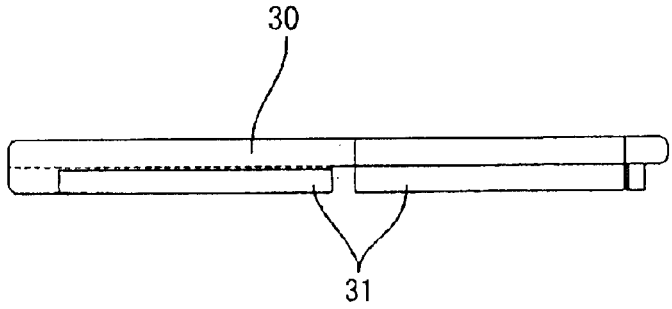
FIG. 12 is a side view of the cover.
Figure 13:
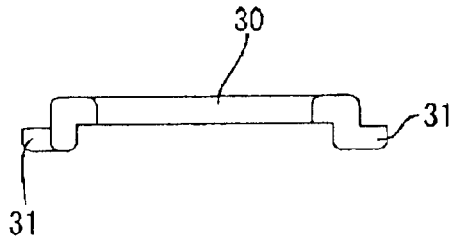
FIG. 13 is a rear view of the cover.
Figure 14:
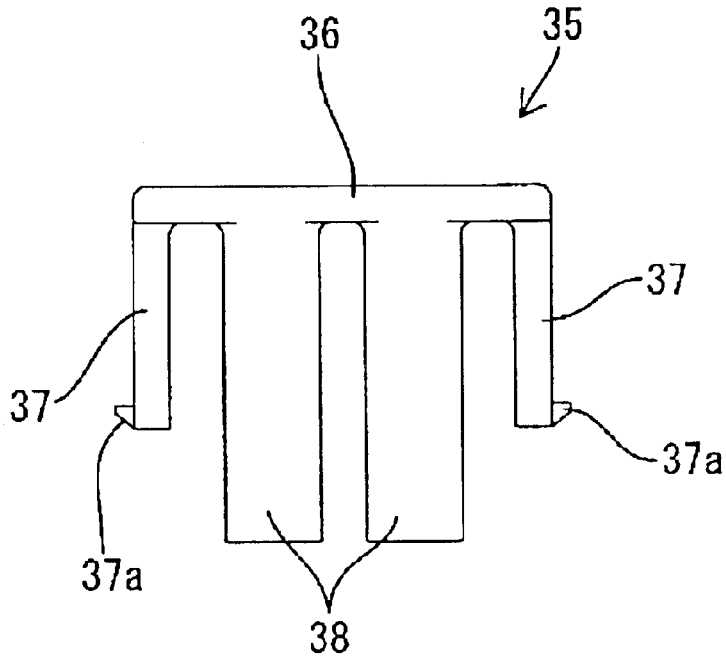
FIG. 14 is a front view of the detecting member.

Left and right first slits 19*a* are formed in the front end of the housing 10 and extend straight in forward and backward directions from the upper surface of the main portion 11 to the upper ends of the deformation permitting spaces 18 (FIG. 10). Likewise, second slits 19*b* extend transversely at the front end of the main portion 11 and communicate with the front ends of the respective first slits 19*a*. second slits 19*b* extend from the upper surface of the main portion 11 to a space before the fitting 12.

The cover 30 is a substantially rectangular flat plate and is assembled with the housing 10 to cover substantially the entire opening of the cavity 13 in the upper surface of the housing 10. Rib-shaped guides 31 are formed at the opposite lateral edges of the cover 30 and can be slid into the guide grooves 16. The cover 30 is formed with first slits 32*a* and second slits 32*b* that align with the first and second slits 19*a*, 19*b* of the housing 10 when the cover 30 is assembled properly with the housing 10. In this properly assembled condition, the cover 30 covers the opening of the cavity 13 and the female terminal fittings 14 in the cavity 13.

The detector 35 can be assembled with the housing 10 and the cover 30 to detect whether the connector Fa is connected properly with the mating connector M. The detector 35 includes a base 36 in the form of a substantially flat plate. Left and right detection ribs 37 project down from the opposite lateral edges of the base 36. Additionally, left and right shorted-state canceling portions 38 project down from the front edge of the base 36. The ribs 37 substantially correspond to the first slits 19*a*, 32*a* of the housing 10 and the cover 30, whereas the shorted-state canceling portions 38 correspond to the second slits 19*b*, 32*b* of the housing 10 and the cover 30. Further, locking projections 37*a* project out at the bottom ends of the ribs 37.

The mating connector M to be connected with the connector Fa has an upwardly open fittable recess Ma for receiving the fitting 12. Left and right substantially tab-shaped male terminal fittings Mb project up into the fittable recess Ma for connection with the female terminal fittings 14. A shorting terminal Mc shorts the male terminal fittings Mb with each other before the connector Fa is connected with the mating connector M. The shorting terminal Mc is positioned to correspond to the second slits 19*b*, 32*b* of the connector Fa when the connectors Fa, M are connected with each other. Further, left and right locking recesses Md are formed in the fittable recess Ma.

The connector Fa is assembled by engaging the rear ends of the guides 31 of the cover 30 with the front ends of the guide grooves 16 of the housing 10 so that the cavity 13 is entirely open upward. The cover 30 is held at this partly assembled position by static friction between the guide grooves 16 and the guides 31 or by a known lock for engaging a projection on the housing 10 or the cover 30. The detector 35 is not assembled with either the housing 10 or the cover 30. The partly assembled housing 10 and cover 30 and the detector 35 then are transported to a harness assembly site.

The female terminal fittings 14 are mounted in the cavity 13 of the housing 10 at the harness assembly site. The cover 30 then is slid along the guide grooves 16 in the longitudinal direction of the main portion 11 and into a properly assembled position. As a result, the cover 30 substantially entirely covers the opening of the cavity 13 in the upper surface of the housing 10. The cover 30 may be held at the properly assembled position by a known lock for engaging a projection on either one of the housing 10 and the cover 30.

The housing 10 with the female terminal fittings 14 accommodated therein then is fitted into the fittable recess Ma of the mating connector M. In the fitting process, the locking projections 17*a* of the lock arms 17 interfere with the upper end of the inner circumference of the fittable recess Ma. Hence, the lock arms 17 deform resiliently into the deformation permitting spaces 18. The lock arms 17 are restored resiliently when the connectors Fa, M are connected properly. Thus, the locking projections 17*a* engage the locking recesses Md so that the two connectors Fa, M are locked in their connected state.

The detector 35 then is assembled with the housing 10 from above by inserting the ribs 37 into the first slits 19*a*, 32*a* and inserting the shorted-state canceling portions 38 into the second slits 19*b*, 32*b*. The lock arms 17 are restored resiliently and retracted outside the deformation permitting spaces 18 if the two connectors Fa, M are connected properly. Thus, the ribs 37 can enter into the deformation permitting spaces 18 and the detector 35 can be assembled deeply to a properly assembled position in the housing 10. On the other hand, the resiliently deformed lock arms 17 are still in the deformation permitting spaces 18 if the two connectors Fa, M are connected only partly. Thus, the ribs 37 interfere with the lock arms 17 and cannot enter into the deformation permitting spaces 18, thereby hindering the assembly of the detector 35 with the housing 10. In other words, the detector 35 can detect the connected state of the two connectors Fa, M by detecting whether it can be assembled with the housing 10 at the properly assembled position.

The locking projections 37*a* of the ribs 37 engage the locking grooves 17*b* of the lock arms 17 to lock the detector 35 at the properly assembled position. The ribs 37 prevent the lock arms 17 from being deformed toward the deformation permitting spaces 18 and away from the locking recesses Md. Thus, the two connectors Fa, M are locked doubly in their connected state.

The shorted-state canceling portions 38 enter the fittable recess Ma and deform the shorting terminal Mc away from the male terminal fittings Mb during the assembly of the detector 35. Thus, the shorted state of the male terminal fittings Mb is canceled.

As described above, the housing 10 and the cover 30 are assembled partly and transferred to a proper assembly site. Accordingly, before the female terminal fittings 14 are mounted, the housing 10, the cover 30 and the detector 35 are prepared as two units. Thus, assembly operability is better as compared to a case where the three parts of the connector are separate.

The cover 30 is guided along a specified path by the engagement of the guide grooves 16 and the guidable portions 31 for proper assembly with the housing 10. The cover assembling operation is facilitated by such a guiding construction, and the housing 10 and the cover 30 can be assembled properly.

Figure 15:
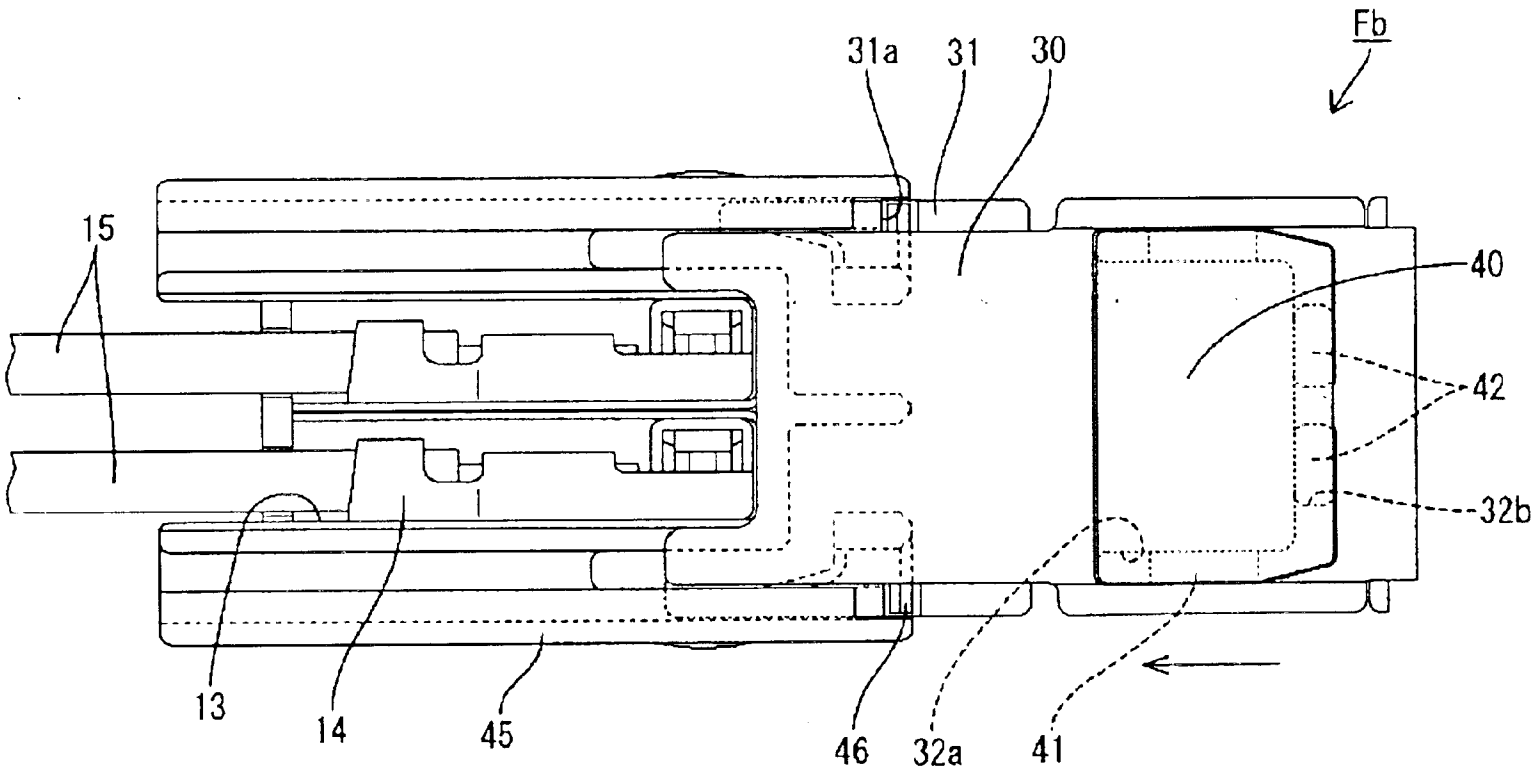
FIG. 15 is a plan view of a second embodiment showing a cover partly assembled with a detector and a housing.
Figure 16:
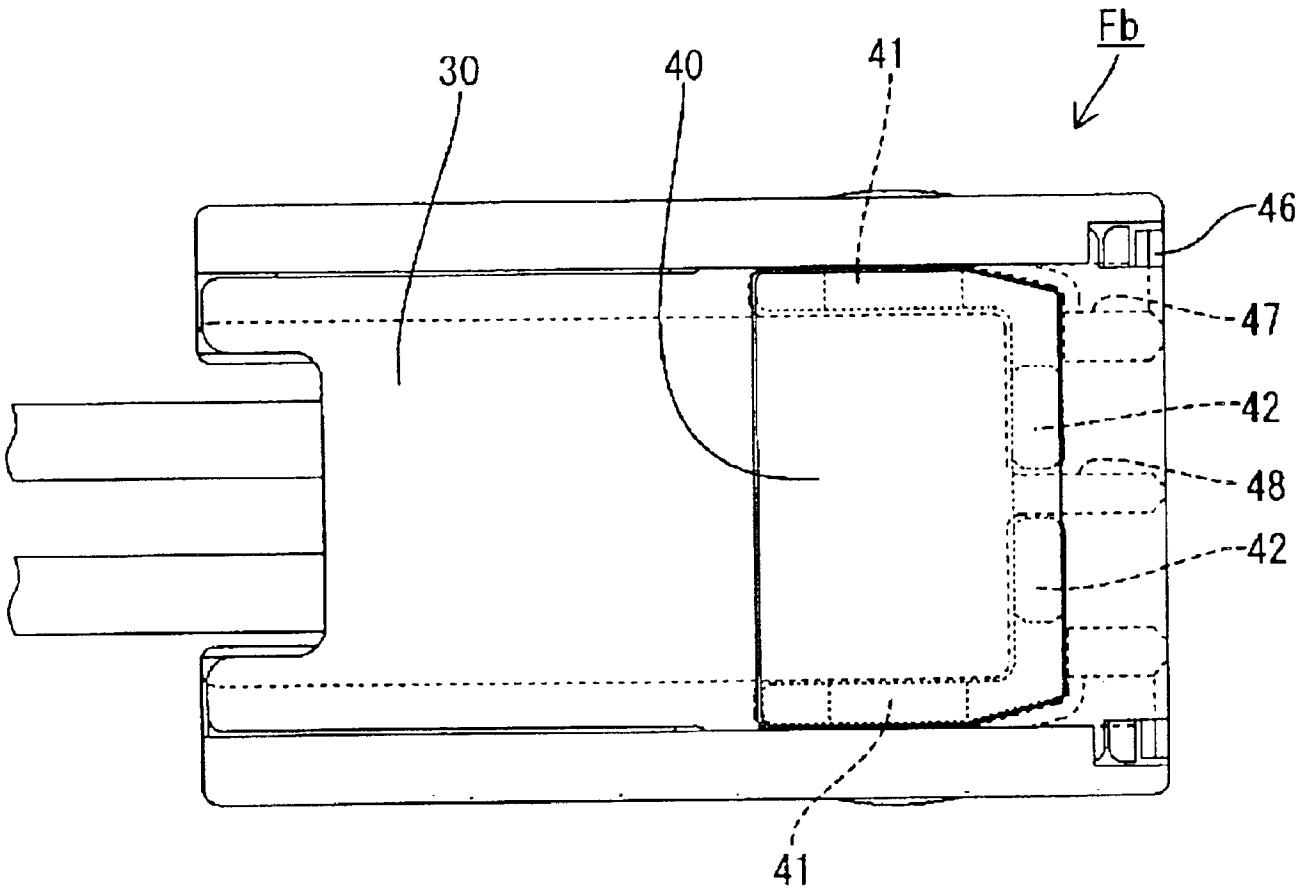
FIG. 16 is a plan view showing the cover properly assembled with the housing.
Figure 17:
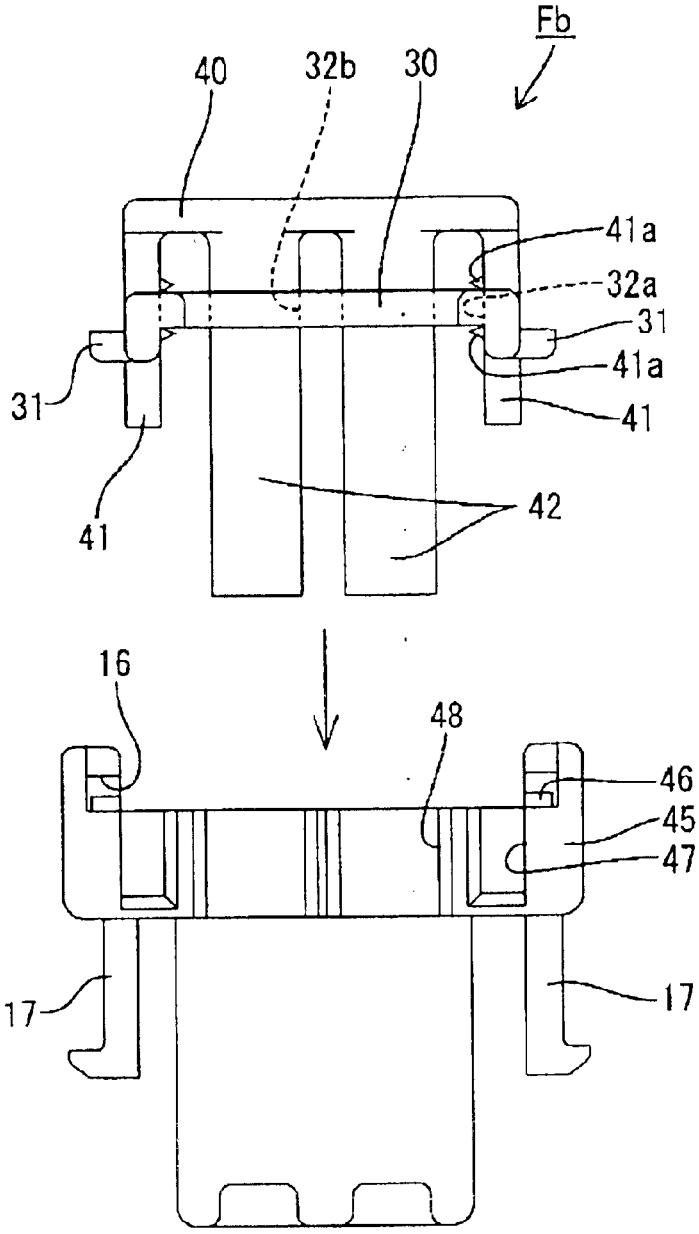
FIG. 17 is a front view showing the cover partly assembled with the detector and separated from the housing.
Figure 18:
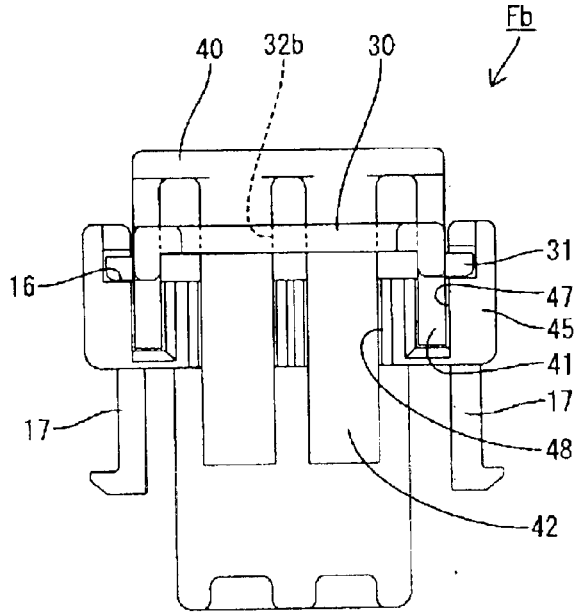
FIG. 18 is a front view showing the cover partly assembled with the detector and with the housing.
Figure 19:
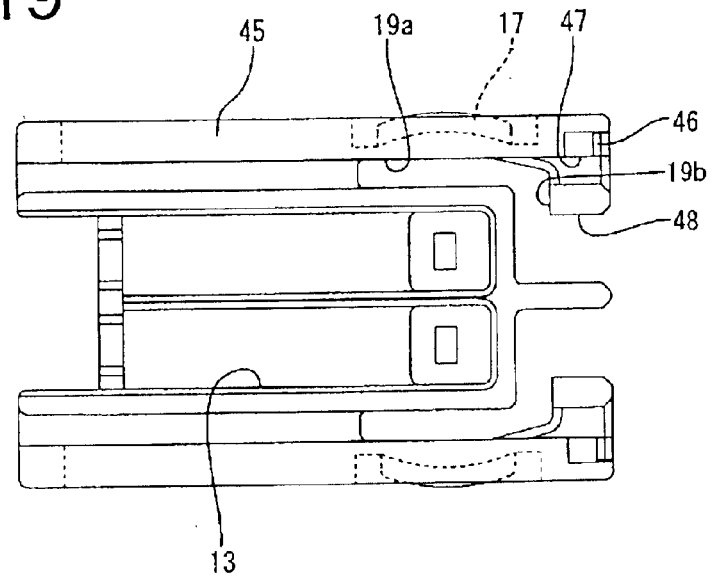
FIG. 19 is a plan view of the housing.

A connector Fb according to a second embodiment of the invention is described with reference to FIGS. 15 to 19. The connector Fb differs from the connector Fa of the first embodiment in that a detector 40 is assembled partly with a cover 30 beforehand. Elements of the second embodiment that are the same as or similar to the first embodiment are not described again, but are identified by the same reference numerals. Additionally, the right side in FIG. 15 is referred to as the front.

The detector 40 is assembled partly with the cover 30 by fitting ribs 41 and shorted-state canceling potions 42 into the first and second slits 32*a*, 32*b*. The detector 40 is held at this partly assembled position by engaging upper and lower partly assembling projections 41*a* on the inner surface of each rib 41 with the upper and lower opening edges of the corresponding first slits 32*a*. The cover 30, with which the detector 40 is partly assembled, is held at a partly assembled position with the housing 45 by engaging partly assembling recesses 31*a* formed in the guidable portions 31 with partly assembling projections 46 formed on the housing 45.

The ribs 41 and the shorted-state canceling portions 42 of the detector 40 face the front end surface of the housing 45 while the cover 30 is in the partly assembled condition. Accordingly, the housing 45 is formed with escaping openings 47, 48 that extend from the front end surface and communicate with the first and second slits 19*a*, 19*b*. The ribs 41 and the short-state canceling portions 42 pass through the escaping openings 47, 48 and into the first and second slits 19*a*, 19*b* as the cover 30 is slid back along the main portion 11 from the partly assembled position to a properly assembled position. Thus, the ribs 41 and the short-state canceling portions 42 do not interfere with the housing 45.

The cover 30 and the detector 40 are partly assembled before the female terminal fittings 14 are accommodated in the housing 45. The female terminal fittings 14 then are placed in the housing 45 and the cover 30 is slid to the properly assembled position with the detector 40 partly assembled. The housing 45 is connected with the mating connector M (not shown in FIGS. 15 to 19) in such a state. After the connection, the detector 40 is pushed from the partly assembled position to a properly assembled position to detect the connected state of the two connectors Fb, M.

The detector 40, the cover 30 and the housing 45 are assembled partly into an integral unit in the second embodiment as described above. Thus, the detecting operation by the detector 40 can be performed quickly after connecting the two connectors Fb, M and operability is good.

Figure 20:
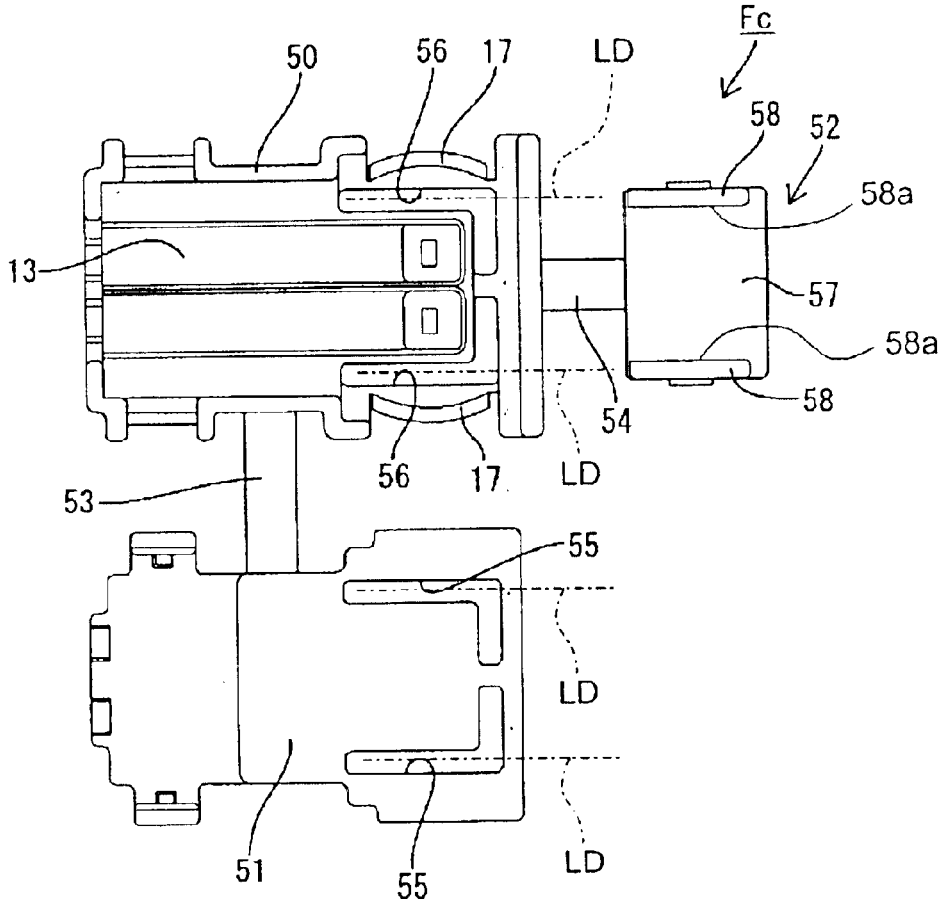
FIG. 20 is a plan view of a third embodiment.

A connector Fc according to a third embodiment is described with reference to FIG. 20. The connector Fc has a housing 50, a cover 51 and a detector 52 that are coupled by hinges 53, 54. Elements of the third embodiment that are the same as or similar to the first embodiment are not described again, but are identified by the same reference numerals. Additionally, the right side in FIG. 20 is referred to as the front.

The hinge 53 projects laterally from an upper outer surface of the housing 50 and a cover 51 is coupled to the projecting end of the hinge 53. The cover 51 is substantially at the same height as the upper surface of the housing 50 and is formed with slits 55. The hinge 53 can be deformed and folded to rotate the cover 51 toward the housing about an axis that extends in forward and backward directions. Thus, the cover 51 can be assembled at a properly assembled position on the upper surface of the housing 50. At the properly assembled position, the slits 55 of the cover 51 substantially align with slits 56 which are open in the upper surface of the housing 50.

The hinge 54 projects forward from the upper end of the front surface of the housing 50. The detector 52 has a substantially planar base 57 coupled to the free end of the hinge 54 and two substantially planar ribs 58 that project from the left and right ends of the base 57. The detector 52 initially is at a non-assembled position with the base 57 at substantially the same height as the upper surface of the housing 50 and with the ribs 58 projecting up. The hinge 54 can be folded about a transverse axis to rotate the detector 52 back toward a properly assembled position with the housing 50.

The housing 50, the hinge 54 and the detector 52 initially are arranged along forward and backward directions. The detector 52 then is rotated back through an arc and into an assembled condition. The slits 55, 56 of the cover 51 and the housing 50 extend parallel to the forward and backward directions, i.e. the arranging direction of the housing 50, the hinge 54 and the detecting member 52. Further, the plate surfaces 58*a* of the ribs 58 are substantially parallel with the trace of displacement of the detector 52 during assembly and also are parallel with the longitudinal direction of the slits 55, 56. Thus, the plate surfaces 58*a* can be inserted easily into the slits 55, 56 without any tilt and the width of the slits 55, 56 can be made substantially as small as the thickness of the ribs 58.

The connector Fc is assembled by first inserting the terminal fittings (not shown) into the housing 50 and then rotating the cover 51 onto the housing 50. The connector Fc then is connected with the mating connector (not shown) while the detector 52 is held at the non-assembled position. The hinge 54 then is deformed to rotate the detector 52 toward the housing 50. Thus, the ribs 58 are inserted into the slits 55, 56 to assemble the detector 52 with the housing 50 and the cover 51 and to verify the connection.

The housing 50, the cover 51 and the detector 52 are unified into a single part by the hinges 53, 54 before being assembled. Hence, assembling operability is better as compared to a case where these three are separate and the number of parts can be reduced.

The ribs 58 of the detector 52 are inserted into the slits 55, 56 of the cover 51 and the housing 50 as the detector 52 is rotated into the properly assembled position. The plate surfaces 58*a* of the ribs 58 move substantially parallel with the longitudinal direction LD of the slits 55, 56 as the detector 52 is rotated. Therefore, it is sufficient for the slits 55, 56 to have an opening width equal to the thickness of the ribs 58.

Figure 21:
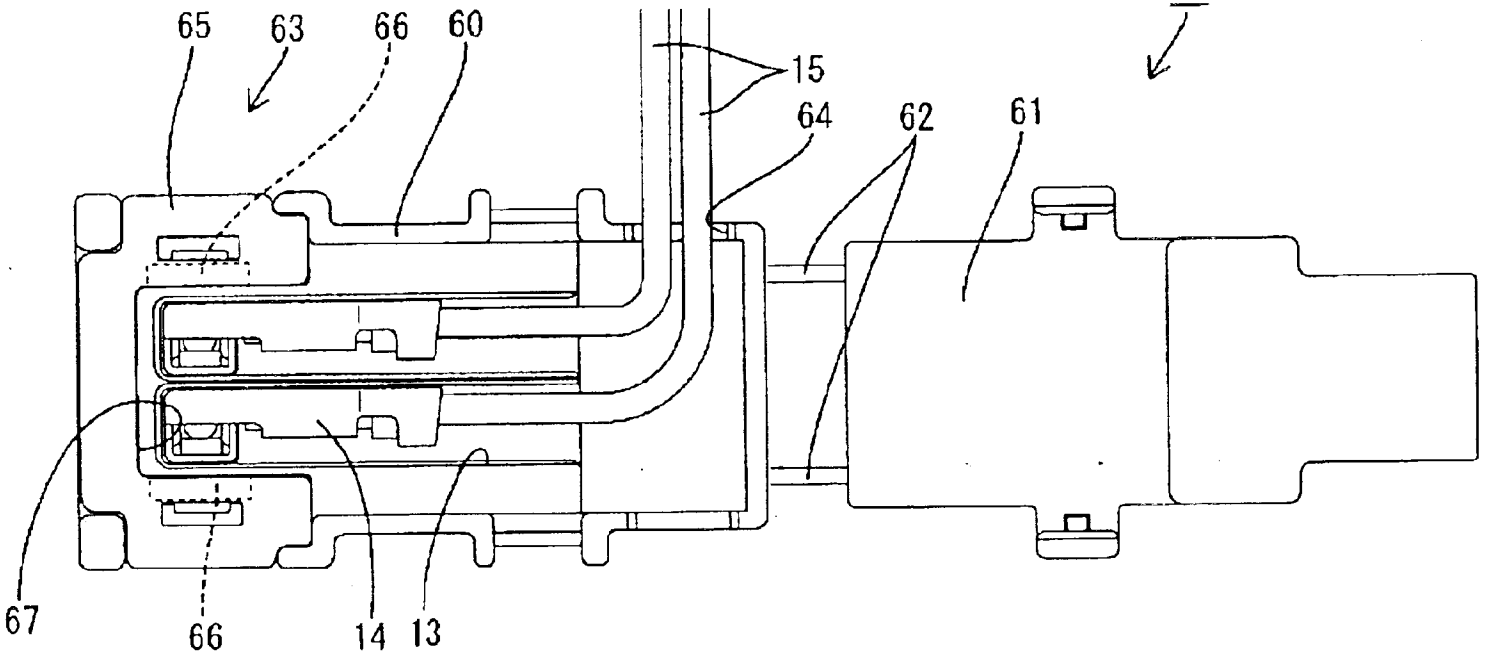
FIG. 21 is a plan view of a fourth embodiment.
Figure 22:
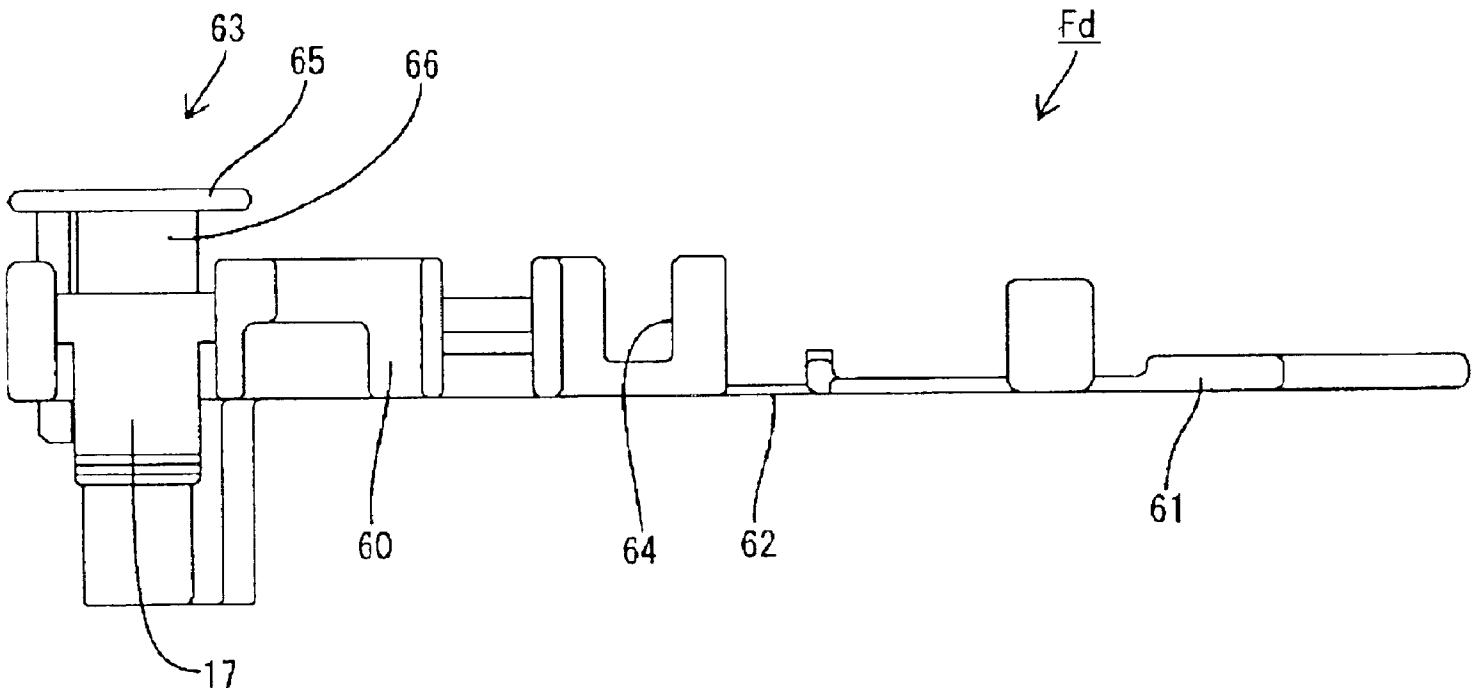
FIG. 22 is a side view of the fourth embodiment.

A connector Fd according to a fourth embodiment is described with reference to FIGS. 21 and 22. The connector Fd has a housing 60, a cover 61 coupled to the housing 60 by a hinge 62 and a detector 63 is assembled with the housing 60 at a partly assembled position. Elements of the fourth embodiment that are the same as or similar to the first embodiment are not described again, but are identified by the same reference numerals. Additionally, the left side in FIG. 21 is referred to as the front.

A groove-shaped draw-out portion 64 is formed at a rear end of the housing 60 by cutting away the upper edge of the right wall of the housing 60 so that the cavity 13 communicates with the outside at the right side of the housing 60. The rear ends of the female terminal fittings 14 accommodated in the cavity 13 are crimped, bent or folded into connection with the wires 15, and the wires 15 are bent substantially at right angles at the rear of the cavity 13 to be drawn transversely out of the housing 60 though the draw-out portion 64.

Hinges 62 project back from the upper end of the rear end surface of the housing 60, and the cover 61 is coupled to the projecting end of the hinge 62. The cover 61 is not formed with the slits 32*a*, 32*b* as described in the first to third embodiments, but is a substantially flat plate for covering the opening of the cavity 13 and the female terminal fittings 14. The hinges 62 are deformed about a transverse axis to rotate the cover 61 toward the housing 60 and into a properly assembled position.

The detector 63 has a plate shaped base 65 and left and right ribs 66 that project down from the base 65. The detector 63 is held at the partly assembled position with the ribs 66 fitted into slits (not shown in FIGS. 21 and 22) of the housing 60. Although not shown, a construction for engaging projections on the ribs 66 with the opening edges of the slits as in the second embodiment is adopted to hold the detector 63 at the partly assembled position. The base 65 has an escaping recess 67 for avoiding interference when the female terminal fittings 14 are accommodated in the cavity 13.

The connector Fd is assembled by initially inserting the female terminal fittings 14 in the housing 60 with the detector 63 partly assembled. The wires 15 then are drawn out to the right side through the draw-out portion 64 in a direction substantially normal to the hinges 62 and the cover 61. Thereafter, the cover 61 is rotated and assembled onto the upper surface of the housing 60. The base 65 is formed with the escaping recess 67. Thus, the assembled cover 61 does not interfere with the base 65 of the detector 63 and the detector 63 remains at the partly assembled position. The connector Fd then is connected with the mating connector M (not shown in FIGS. 21 and 22). Finally, the detector 63 is pushed down from the partly assembled position to the properly assembled position to verify connection.

As described above, the housing 60 and the cover 61 are unified into an integral or unitary part by the hinges 62 and the detector 63 is assembled partly with the housing 60 before the connector Fd is assembled. Thus, the connector Fd is a single unit before being assembled. Accordingly, assembling operability is better as compared to a case where these three are separate parts and the number of parts can be reduced.

The detector 63 is assembled partly with the housing 60 before the housing 60 assembled with the cover 61 is connected with the mating connector M. Thus, the detection by the detector 63 can be performed quickly after connecting the two connectors Fd, M, and operability is good.

The hinges 60 couple the cover 61 to the rear end of the housing 60. However, the wires 15 that extend back from the rear ends of the female terminal fittings 14 are bent in the cavity 13 and are drawn out to the right side through the draw-out portion 64. Hence, the wires 15 do not interfere with the hinges 62 and the cover 61.

Figure 23:
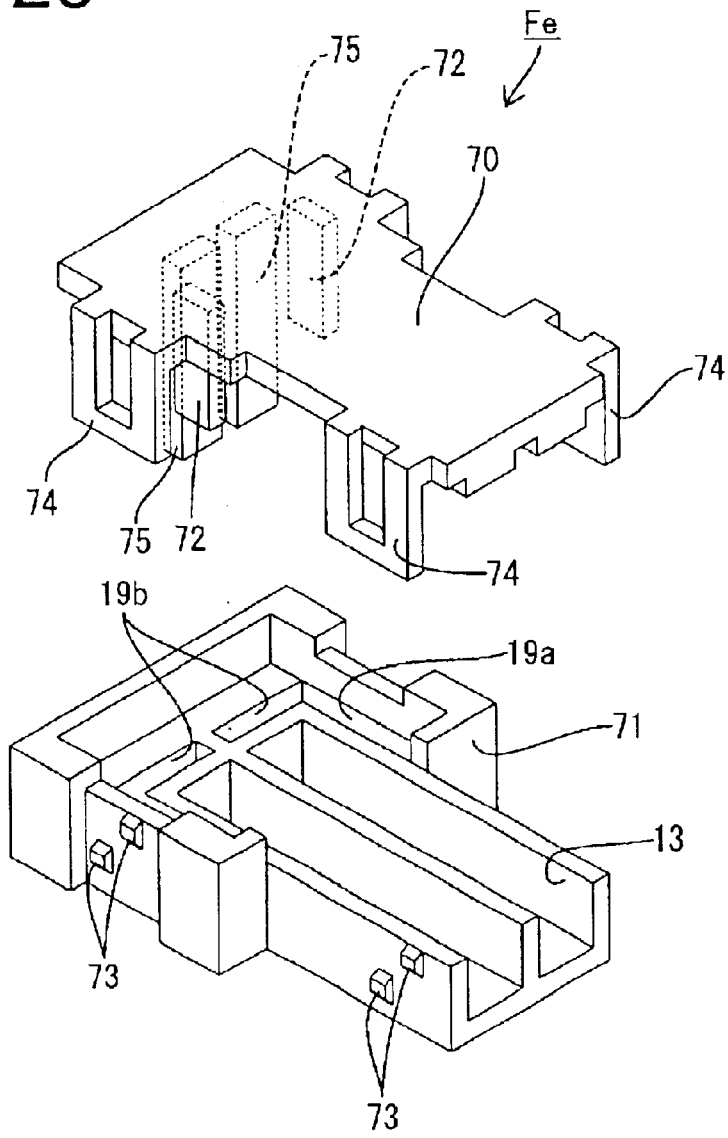
FIG. 23 is a perspective view showing a state where a cover is separated from a housing in a fifth embodiment.
Figure 24:
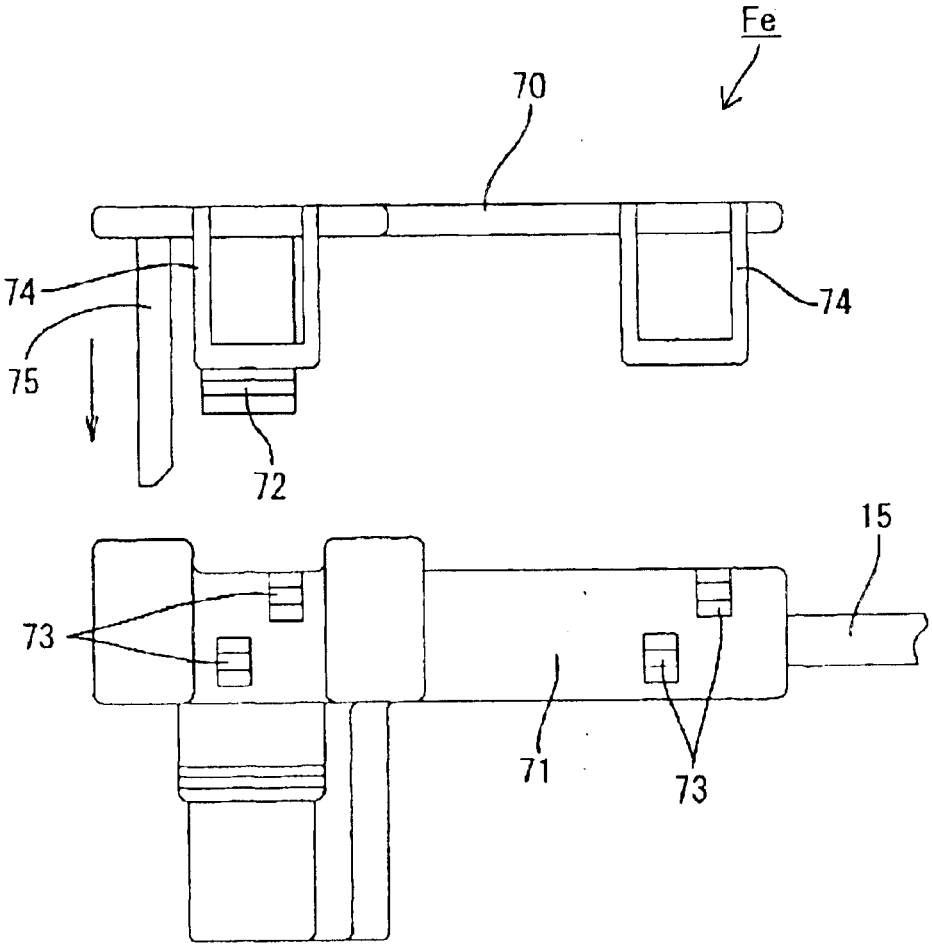
FIG. 24 is a side view showing the cover separated from the housing.
Figure 25:
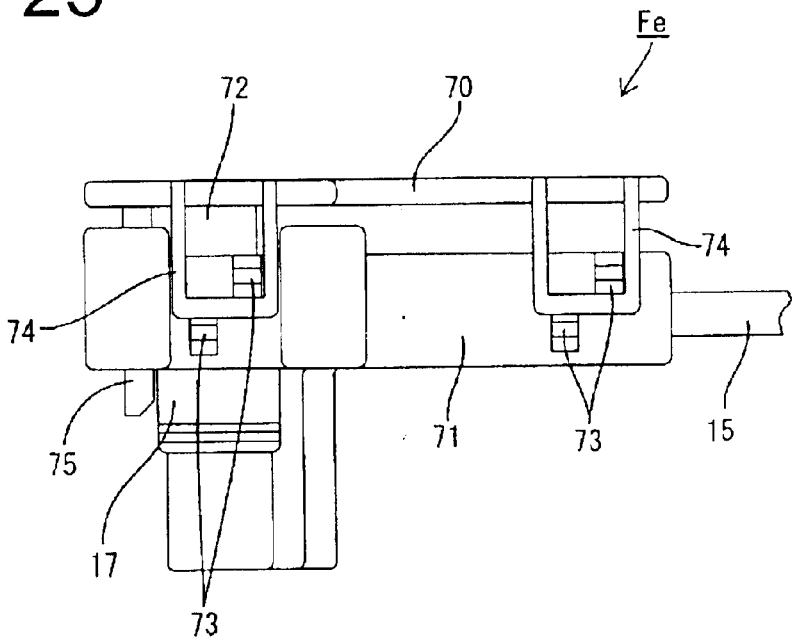
FIG. 25 is a side view showing the cover partly assembled with the housing.
Figure 26:
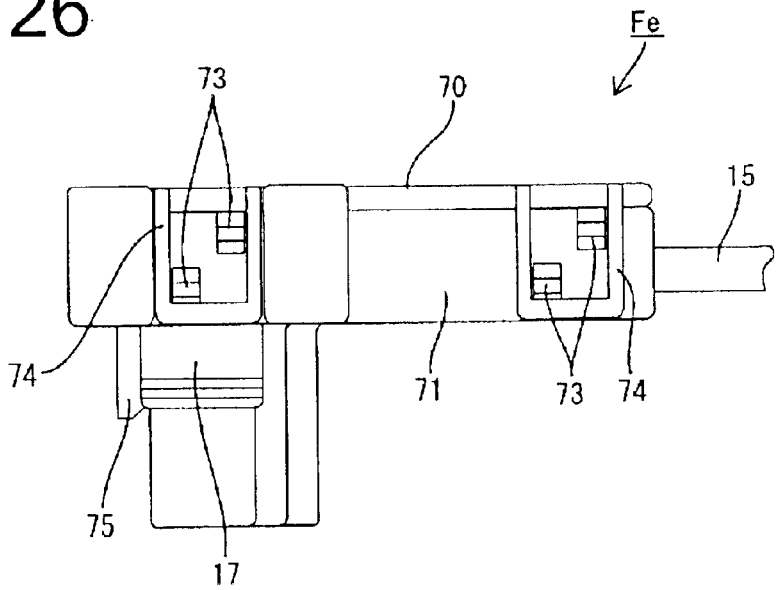
FIG. 26 is a side view showing the cover properly assembled with the housing.

A connector Fe according to a fifth embodiment is described with reference to FIGS. 23 and 26. The connector Fe has a cover 70 assembled with a housing 71 for movement between a partly assembled position and a properly assembly position, and detecting portions 72 are formed integrally or unitarily with the cover 70. Elements of the fifth embodiment that are the same as or similar to the first embodiment are not described again, but are identified by the same reference numerals.

Cavities 13 are formed in the housing 71, and locks 73 are provided at two front and rear positions of each of the left and right outer sidewalls of the housing 71. The housing 71 also is formed with first slits 19*a* and slits 19*b*. The cover 70 is in the form of a substantially flat plate and substantially U-shaped locking pieces 74 project down at two front and rear positions of each of the left and right edges of the cover 70. Left and right substantially rib-shaped detectors 72 and a pair of short-state canceling portions 75 project substantially normally down from the bottom surface of the cover 70.

The connector Fe is assembled by first placing the female terminal fittings 14 in the cavities 13 from above. The cover 70 then is moved from above into a partly assembled position on the housing 71 where the cover 70 is spaced from the upper surface of the housing 71. The cover 70 is held in this state by engaging the bottom ends of the locking pieces 74 between the corresponding upper and lower locks 73. The detectors 72 are inserted only slightly into the first slits 19*a* when the cover 70 is in the partly assembled state. Hence the detectors 72 do not display their connection detecting function even if the connector Fe is connected with the mating connector M (not shown in FIGS. 23 to 26). Likewise, the short-state canceling portions 75 are fit only slightly into the second slits 19*b*, and do not cancel a shorted state even if the connector Fe is connected with the mating connector M.

The cover 70 is pushed down toward the housing 71 to a properly assembled position after the housing 71 after the connector Fe is connected with the mating connector M. The detectors 72 can enter the deformation permitting spaces 18 (not shown in FIGS: 23 to 26) for the lock arms 17 when the housing 71 is connected properly with the mating connector M, and thus the cover 70 can be moved to the properly assembled position. If, on the contrary, the connectors Fe, M are left partly connected, the detectors 72 interfere with the lock arms 17 in the deformation permitting spaces 18, and the cover 70 cannot be pushed down to the properly assembled position. In other words, the connected state of the two connectors Fe, M can be detected based on whether the cover 70 can be assembled at the properly assembled position.

At the same time the cover 70 reaches the properly assembled position, the short-state canceling portions 75 contact the shorting terminal Mc (not shown in FIGS. 23 to 26) of the mating connector M and resiliently deform it, to display their shorted-start canceling function.

As described above, according to this embodiment, the housing 71, the cover 70 and the detecting portions 72 are unified into an integral unit before being assembled with each other. Thus, assembling operability is better as compared to a case where these three are separate. Further, the detectors 72 are formed integrally with the cover 70, and the number of parts can be reduced. Furthermore, the connected state with the mating connector M can be detected based on whether the cover 70 can be moved from the partly assembled position to the properly assembled position. Consequently, the assembling of the cover 70 and connection detection by the detectors 72 can be performed by one action. Thus, operability is good.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The cover and/or the detecting means may be supported rotatably on the housing by a shaft-supporting construction in the first to fifth embodiments.

The cover and the detecting means may be coupled to each other by a shaft-supporting construction in the first to fifth embodiments.

The detecting means may be locked slideably with the housing in the first and second embodiments.

A hinge may couple the cover and the detecting means to each other in the first and second embodiments.

The cover or the detecting means may be separated from the housing and the cover and the detecting means may be coupled directly to each other via a hinge in the third embodiment.

The detecting means may be separated from the housing and slidably supported on the cover in the third embodiment.

The coupled position of the cover to the housing may be at the opposite side from the detecting means with respect to the housing or may be at the same side as the detecting means in the third embodiment.

The cover may be assembled slideably with the housing in the fourth or fifth embodiment.

Instead of the cover, the detecting means may be coupled to the rear end of the housing in the fourth embodiment.

The cover may be coupled to the housing via a hinge in the fifth embodiment.

It should be understood that one or more terminal fittings may be accommodated in the cavity and that a corresponding number of detecting means may be provided for detecting or verifying a correct connection with mating terminal fittings of the mating connector.

What is claimed is:

1. A connector, comprising:

a housing with opposite front and rear ends and at least one cavity extending between the ends for accommodating at least one terminal fitting inserted along an inserting direction, opposed facing guide grooves substantially adjacent the rear end of the housing and extending substantially perpendicular to the insertion direction defined by the cavity;

a cover having oppositely directed ribs slidably assembled in the guide grooves of the housing at a partly assembled cover position where the terminal fitting can be inserted into the cavity and being slidably movable substantially perpendicular to the insertion direction to a properly assembled cover position for substantially covering the cavity and the terminal fitting, a detecting means movable substantially perpendicular to the sliding direction of the cover for detecting whether the housing is connected properly with a mating connector based on whether the detecting means can be assembled with the housing at a properly assembled detector position, and a unifying means for holding the housing and the cover at the partly assembled cover position by static friction for transfer to an assembly site.

2. The connector of claim 1, wherein the detecting means is assembled with one of the housing and the cover at a partly assembled detector position, and wherein the detecting means is movable to the properly assembled detector position to detect whether the housing is connected. properly with the mating connector.

3. The connector of claim 1, wherein the detecting means interferes with a locking means when the housing is assembled properly with the mating connector.

4. The connector of claim 1, wherein at least two terminal fittings are accommodated in the housing, the terminal fittings are shorted by short-circuiting means and the shorted state is interrupted by shorted-state interrupting means when the connector is mated properly with the mating connector.

5. A method for assembling a connector, comprising the following steps:

providing a housing with at least one cavity in which at least one terminal fitting can be accommodated, assembling a cover by static friction at a partly assembled cover position where the terminal fitting can be accommodated in the cavity;

transferring the housing and the cover at the partly assembled position to a proper assembly site;

inserting the terminal fitting along an insertion direction into the cavity;

moving the cover slidably in a moving direction substantially perpendicular to the insertion direction by overcoming the static friction retaining the cover at the partly assembled position so that the cover moves from the partly assembled cover position to a fully assembled cover position for covering the cavity and the terminal fitting therein, and detecting whether the housing is connected properly with a mating connector based on whether a detecting means can be assembled with the housing at a properly assembled detector position by moving the detecting means substantially perpendicular to the moving direction of the cover.

6. The connector of claim 1, wherein the connector is connectable with the mating connector along a mating direction, the cover being movable from the partly assembled cover position to the properly assembled cover position along a direction substantially transverse to the mating direction.

* * * * *